US005711452A

United States Patent [19]

Chaffin

[11] Patent Number: 5,711,452

[45] Date of Patent: Jan. 27, 1998

[54] VALVE CONTROLLED RECEPTACLE COVER

[76] Inventor: Jeffrey D. Chaffin, 3255 S. Parker Rd., #2-302, Aurora, Colo. 80014

[21] Appl. No.: 575,949

[22] Filed: Dec. 22, 1995

Related U.S. Application Data

[63] Continuation-in-part of Ser. No. 354,162, Dec. 8, 1994, Pat. No. 5,477,980.

[51] Int. Cl.[6] ..... B65D 3/02

[52] U.S. Cl. ..... 220/715; 220/710.5; 220/714; 222/484; 222/517; 222/556

[58] Field of Search ..... 220/715, 714, 220/710.5, 254; 222/484, 517, 556

[56] References Cited

U.S. PATENT DOCUMENTS

| | | | |
|---|---|---|---|
| 523,094 | 7/1894 | Wilson | 222/517 X |
| 1,486,199 | 3/1924 | Skiles | 222/517 X |
| 2,304,457 | 12/1942 | Hagan | 222/484 X |
| 2,574,338 | 11/1951 | Lewis | 222/484 X |
| 4,099,642 | 7/1978 | Hergard | 220/90.4 |
| 4,121,731 | 10/1978 | Okerstrum | 220/715 |
| 4,133,446 | 1/1979 | Albert | 220/90.4 |
| 4,276,992 | 7/1981 | Susich | 220/254 |
| 4,303,173 | 12/1981 | Nergard | 220/254 |
| 5,169,016 | 12/1992 | Hinz, Jr. | 220/254 |
| 5,477,980 | 12/1995 | Chaffin | 220/715 |

*Primary Examiner*—Steven M. Pollard
*Attorney, Agent, or Firm*—Henderson & Sturm

[57] ABSTRACT

A cover 10 for a drink receptacle 12 wherein the cover 10 is provided with a pair of valve members 55 for simultaneously controlling the flow of fluid through a fluid supply chamber 26 and a vent chamber 27 by means of an actuator element 50 which is mounted for reciprocation between the base unit 20 and the lid unit 40 of the cover 10 by means of a handle element 51 which extends beyond the periphery of the base unit 20.

12 Claims, 3 Drawing Sheets

VALVE CONTROLLED RECEPTACLE COVER

BACKGROUND OF THE INVENTION

This is a continuation-in-part of patent application Ser. No. 08/354,162 filed on Dec. 8, 1994, 5,477,980, and entitled "Receptacle Cover with Valve Controlled Openings", the entire content of which is hereby incorporated by reference.

1. Field of the Invention

The present invention relates to receptacle covers. More specifically, it relates to a construction for a cover of a drinking glass or mug that allows the user to drink from the glass while in motion or otherwise occupied, while not accidentally spilling the contents thereof. Even more specifically, it relates to a cover construction for a receptacle wherein a biased lever or activator connected to valves on top of the cover is pressed to allow fluid communication between the interior of the receptacle and the exterior. This communication is at two points: the first being the drinking mouth, and the other being a vent to allow the contents of the receptacle to flow smoothly. When the lever is released, the valves seat themselves on the cover top.

More generally, the invention relates to any application where it is desired that the contents of a receptacle or container be selectively in or out of fluid communication with the exterior thereof, such as a storage tank or like object. Furthermore, the contents of the receptacle would not necessarily have to be a liquid in fact: it would be conceivable for the contents to be solid, granular in nature for instance, such as in a grain storage silo. Additionally, though the nature of the closure described herein is that of a cover, it should be understood that a side, or even bottom mounting of the closure according to the instant invention would be within the scope of the invention.

Thus, it can be seen that the potential fields of use for this invention are myriad, and the particular preferred embodiment described herein is in no way meant to be limiting the particular field chosen for exposition of the details of the invention.

2. Description of the Prior Art

Covers with manually controllable valves are well known devices. These apparatus are sometimes used to keep liquids from spilling from a receptacle wile the user is in motion. If one looks around on busy roads during a morning commute in an urban area, these devices are practically ubiquitous, with people drinking coffee or tea as they drive. Other uses, of course, are obvious: use during sports such as running, cycling, or competitive walking (race walking), while boating, or any endeavor wherein the user would be in movement, either under their own power or by mechanical means. Covers such as these can also be used to insulate the contents of the receptacle, limiting the heat exchange with the ambient outer environment, except when desired by the user. One of the disadvantages of these prior art devices is that many parts extend into the receptacle's interior. This leads to Sticky operation (since many people put sugar into their coffee, or that many beverages contain sugar as one of their ingredients), and presents difficulty when the user attempts to clean the apparatus. One of the advantages of the present invention is that contact between elements of the valve linkage apparatus and the contents of the receptacle is kept to a minimum. Another advantage of the instant invention is the construction of the "straw-like" fluid conduit plenum or chamber. This extends upwards from the top of the cover and prevents inadvertent spillage while the valves are in the open position, and also prevents the gradual fluid buildup around the lip of the receptacle as is seen with contemporary art devices. Additionally, the apparatus as described herein can be constructed such that it is easy to clean. During a search at the U.S. Patent and Trademark Office, a number of patents were uncovered that relate to the invention described herein.

Firstly, in U.S. Pat. No. 4,099,642 issued on Jul. 11, 1978 to Orv Nergard them is disclosed a drinking receptacle cover and valve assembly. IN this device, an actuating member terminating in a manually operable push button is disposed diametrically opposite the beverage outlet opening in the flat plate portion of the cover. Opposite the push button portion of the actuating member is a camming surface that engages with a cooperating camming surface located on the underside of a valve head. The valve head is dimensioned to close the beverage outlet and is biased to do so by integrally formed resilient arms. Also integral to the valve head is a resilient strip terminating in a fork that engages a collar on the actuating member proximate the interior surface of the cover. Thus, the actuating member is biased outwardly, and only on the pressing of the push button are the interengaging camming surfaces moved into relationship with one another. Compare this to the instant invention wherein the interengagement of the actuating portion and a rotating rod that transmits the trigger movement to the valves is carried out by wires or like objects that connect the trigger, rod, and valves; and that the valve members engage the top of the cover, without extending down into the interior of the receptacle as the Nergard '642 shows.

In U.S. Pat. No. 4,133,446 issued on Jan. 9, 1979 to Kenneth J. Albert, there is disclosed a drinking vessel cover with valve controlled openings. The cover has an inclined flat wall at its top that has therein a drinking opening and a relief vent, diametrically opposed to one another. Depending from the underside of the wall are two lugs. These lugs are formed with journal recesses that carry a lever such that a pivotal mounting is created. One end of this pivoting lever carries a stub arm that extends through the drinking opening and a valve member on the end thereof dimensioned so that the opening is closed off when the valve member engages the upper surface of the top cover wall. At the distal end of the lever is a valve member and a pushbutton portion that extends through the relief vent to project above the cover. A leaf spring biases the lever such that the valve member closes the drinking opening unless the pushbutton is pressed. Contrast this to the present invention where the entire linkage between the actuator and the valves is described as being located above the top of the receptacle cover, isolating much of the present apparatus from the receptacle contents.

U.S. Pat. No. 4,276,992 issued on Jul. 7, 1981 to Roland J. Susich discloses a drinking cup with a laterally actuated valve. The valve is normally biased against the bottom surface of the cap by a flexible arm. When the actuator, a trigger that engages a rod, is pressed, a camming surface carried by the rod engages a portion of the valve, forcing it downwards against the impetus of the flexible arm. The rod itself has a biasing arm attached to keep the valve in a normally closed position. As in the patents described hereinabove, most of the elements in the Susich patent are disposed below the surface of the cover, thus exposing them to the contents of the receptacle with the concomitant disadvantages outlined previously and clearly differentiating the Susich patent from the instant invention.

Lastly, U.S. Pat. No. 4,303,173 issued on Dec. 1, 1981, also to Orv B. Nergard discloses a mug type drinking receptacle with cover and valve wherein a trigger and rod actuating system, with the rod carrying a camming surface distal the trigger, engages a valve, normally biased against the lower portion of the cover top, and forcing it downwards and away therefrom. The trigger is disposed 90° away from the dispensing aperture. Again, this does not teach the instant invention as described herein, in that all of the linkage elements of Nergard '173 are in potential contact with the contents of the receptacle, by virtue of being located in the interior thereof.

None of the above inventions and patents, taken either singly or in combination, is seen to describe the instant invention as claimed.

SUMMARY OF THE INVENTION

The present invention comprises an improved valve arrangement for the receptacle cover incorporating an elongated actuator operatively connected to a pair of biased valves that seal off the fluid supply inlet and the vent from the top side of the cover. This construction isolates the valves and the actuator unit from the contents of the receptacle. The actuator unit comprises a contoured handle element disposed on one end of a generally T-shaped actuator element which is disposed in a spring biased reciprocating fashion in the base unit of the receptacle cover. In addition, a lid unit cooperates with the base unit of the receptacle cover to at least partially envelope the actuator unit, and is further provided with a raised peripheral lip and mouthpiece along with a generally flush vent aperture to confine and drain liquids that are spilled on the top portion of the lid unit.

Accordingly, it is a principal object of the invention to provide a receptacle cover incorporating valve controlled openings that overcomes the disadvantages of the prior art in a simple but effective manner.

It is another object of the invention to provide a receptacle cover incorporating valve controlled openings wherein the actuator unit is substantially isolated from the contents of the receptacle.

It is a further object of the invention to provide a receptacle cover incorporating valve controlled openings where the dispensing chamber also serves to prevent fluid buildup on the exterior of the receptacle by channelling undrunk liquid quickly back into the receptacle interior.

Still another object of the invention is to provide a receptacle cover incorporating valve controlled openings wherein the construction of the cover allows it to be easily cleaned.

It is a major goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
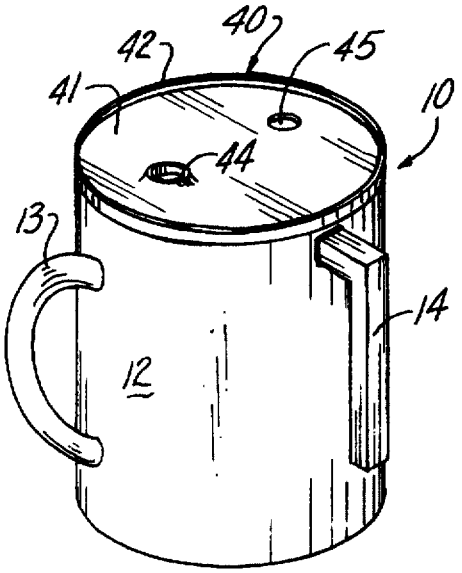
FIG. 1 is a perspective view of a drink receptacle equipped with the improved receptacle cover that forms the basis of the present invention.

As can be seen by reference to the drawings, and in particular to FIG. 1, the improved drinking receptacle cover that forms the underlying basis of the present invention is designated generally by the reference number 10 and is shown operatively disposed on a drinking receptacle 12. The cover 10 is removably attached to the drink receptacle 12 by threaded engagement means or the like 22 shown in FIGS. 7 and 8 to provide a leakproof seal.

Figure 2:
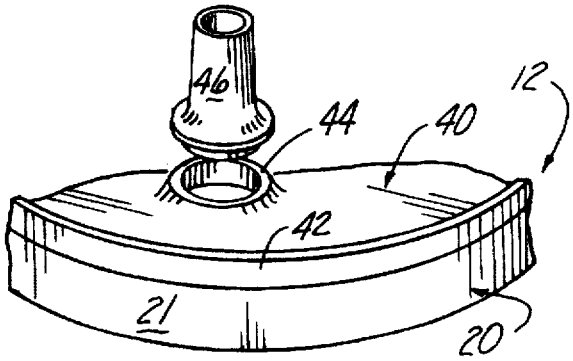
FIG. 2 is an isolated detail view of an auxiliary straw holder extension element.
Figure 3:
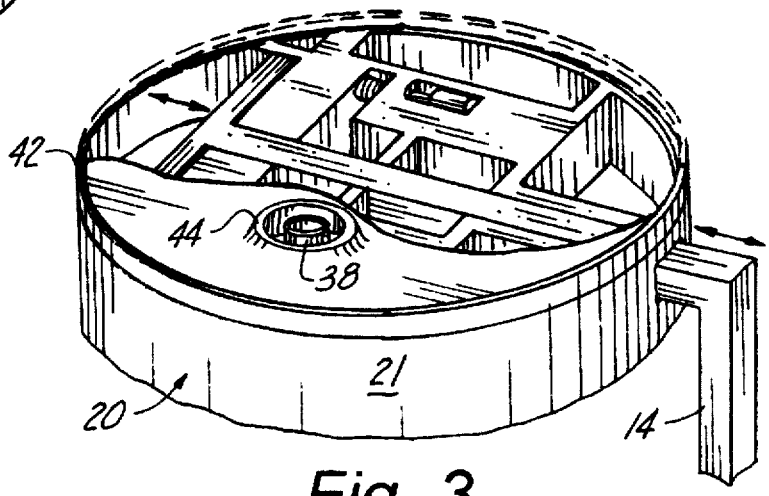
FIG. 3 is a partial cut-away view of the top of the receptacle cover member.

As shown in FIGS. 2 and 3, the receptacle cover 10 comprises a base unit 20 and a lid unit 40 which partially surround an actuator unit 14 which will be described in detail further on in the specification.

Figure 7:
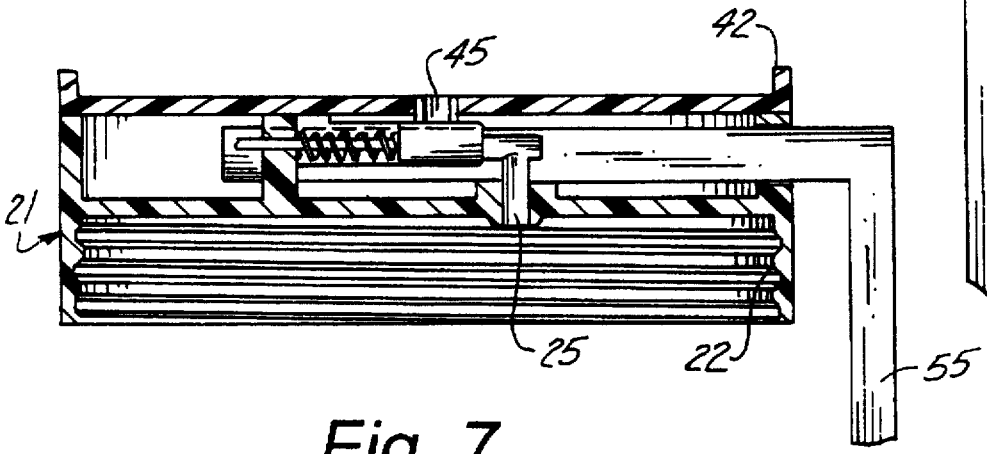
FIG. 7 is a cross-sectional view showing the actuator unit and associated valves in the closed position.
Figure 8:
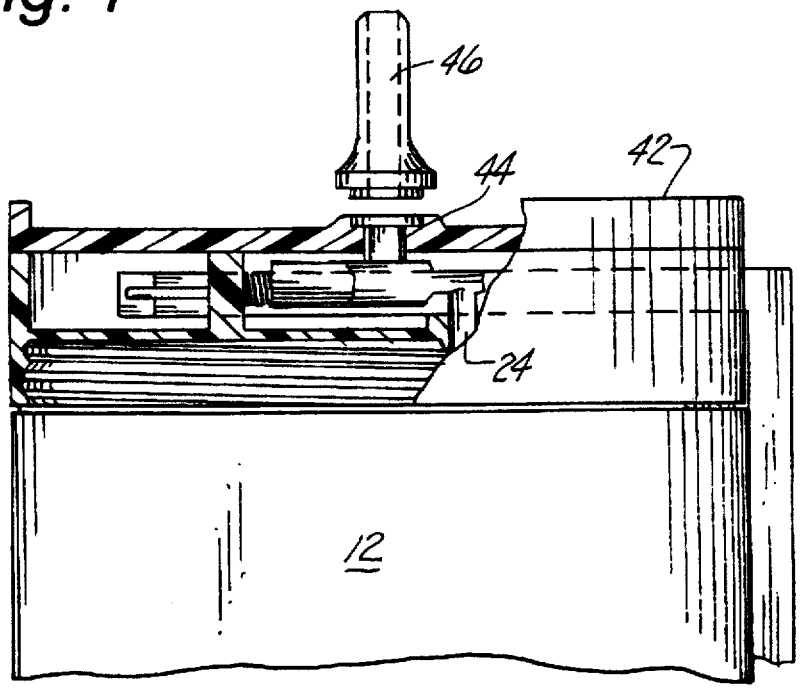
FIG. 8 is a cross-sectional view showing the actuator unit and associated valves in the open position.

As can best be seen by reference to FIGS. 3, 7, and 8, the base unit 20 is provided with an elongated sidewall 21 having threaded engagement means 22 disposed on the lower interior portion thereof. In addition, the base unit 20 is also provided with a generally horizontally disposed base plate 23 having an inlet supply aperture 24 and a base vent aperture 25 provided therein.

Figure 5:
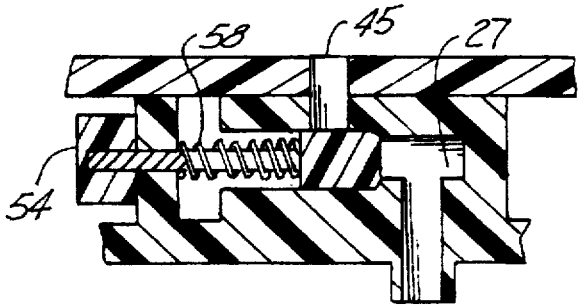
FIG. 5 is a cross-sectional view showing the vent chamber valve in the closed position.

As shown in FIGS. 3 and 5, the upper portion of the base plate 23 is divided into ported partition compartments including an elongated fluid supply chamber 26 and an elongated vent chamber 27, wherein each of the chambers 26 and 27 are provided with an inlet valve seat 28 and an outlet valve seat 29 disposed generally perpendicular to one another.

Figure 6:
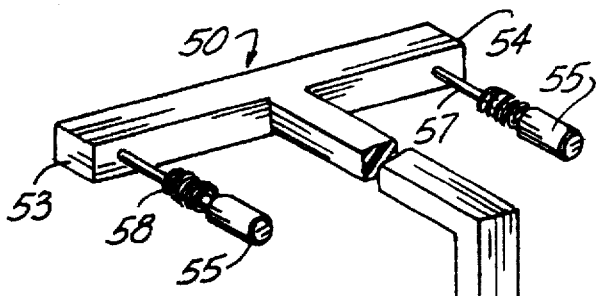
FIG. 6 is an isolated perspective view of the actuator unit.

Turning now to FIG. 6, it can be seen that the actuator unit 15 comprises a generally T-shaped actuator element 50 provided with a handle element 51 which depends downwardly from the base portion 52 of the T-shaped actuator element 50. In addition, the outboard ends of the arms 53, 54 of the actuator element 50 are provided with valve members. 55, wherein each of the valve members 55 comprise an elongated generally resilient valve head 56 operatively connected to the actuator arms 53, 54 via a valve stem 57 which is further provided with a helical spring element 58 which slideably engages the valve stem 57.

Figure 4:
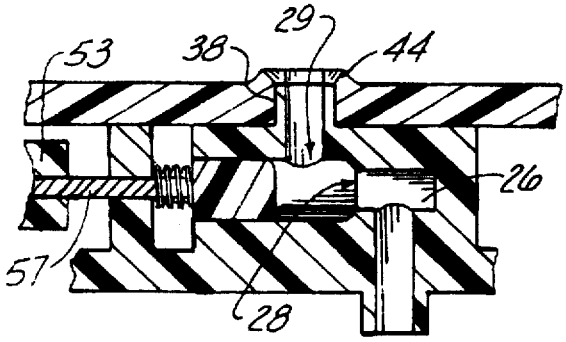
FIG. 4 is a cross-sectional view showing the supply chamber valve in the open position.

As can best be seen by reference to FIGS. 3 through 5, the partitioned compartments in the upper portion of the base plate 23 are further provided with a central passageway 30 which extends through the sidewalls 21 on one side of the base unit 20 and which is dimensioned to slideably receive the stem portion 51 of the actuator member 50 in a well recognized fashion.

In addition, discrete apertures 31 are provided in the partitions that are disposed opposite the portion chambers 26 and 27 wherein the apertures are dimensioned to slideably receive the valve stem 57 which project inwardly from the arms 53, 54 of the actuator element 50.

As can best be seen by reference to FIGS. 4 and 5, the valve stem 57, the helical spring 58 and the elongated valve head 56 are dimensioned to project into the inlet supply chamber 26 and the vent chamber 27 wherein when the helical spring 58 is in its relaxed state, the valve head 56 sealingly engages the inlet 22 and outlet 29 valve seat in a well recognized manner. However, as shown in FIG. 4, when the helical spring 58 is compressed by the handle element 51, moving the actuator element 50 away from the discrete apertured partitions, the valve head 56 is retracted from engagement with the valve seats 28 and 29 to open up fluid communication through the chambers 26 and 27.

As can be seen by reference to FIGS. 1 through 4, the lid unit 40 comprises a lid member 41 having a slightly raised peripheral lip 42 for containing spilled liquid wherein the lid member 41 is further provided with a slightly raised mouthpiece 44 and a generally flush lid vent aperture 45. In addition, the mouthpiece 44 is further dimensioned to receive a snap-in extension element 46 that can function either as a sipping tube or as a support for a conventional straw.

As shown in FIG. 4, the outlet port of the fluid supply chamber 26 is provided with a short tubular projection 38 which extends into the raised mouthpiece 44 of the lid unit 40 whereas, the outlet port of the vent chamber 27 is disposed flush with the vent aperture 45.

In the preferred embodiment of the invention depicted in FIG. 1, the receptacle 12 is provided with a handle 13 for lifting and transporting the receptacle wherein the actuator unit 14 is provide solely for the purpose of controlling fluid flow through the cover 10. When the handle element 51 of the actuator unit 14 is fully extended from the receptacle cover 10 no fluid can pass through the cover 10. However, when the user manually depressed the handle element 51, the actuator element 50 unseats the valve heads 58 from the valve seats 28 and 29 to open fluid communication through the receptacle cover in a well recognized fashion to provide a virtually spill proof fluid delivery system.

In the alternate version of the receptacle cover 10' the actuator element 150 comprises a generally elongated actuator rod 152 operatively attached to a pair of valve members 160; wherein, each valve member 160 includes a generally L-shaped valve arm 161 having a valve head 162 mounted on the outboard end thereof.

In addition, each of the valve arms 161 is provided with a spring biasing element 163 which is disposed between each valve arm 163 and one of the partitioned walls in the compartmented base unit 20.

Figure 10:
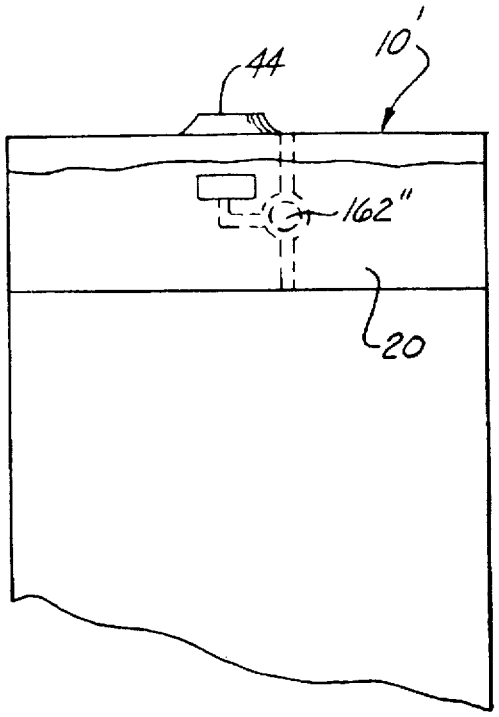
FIG. 10 is a side view of the alternate version of the receptacle cover.
Figure 9:
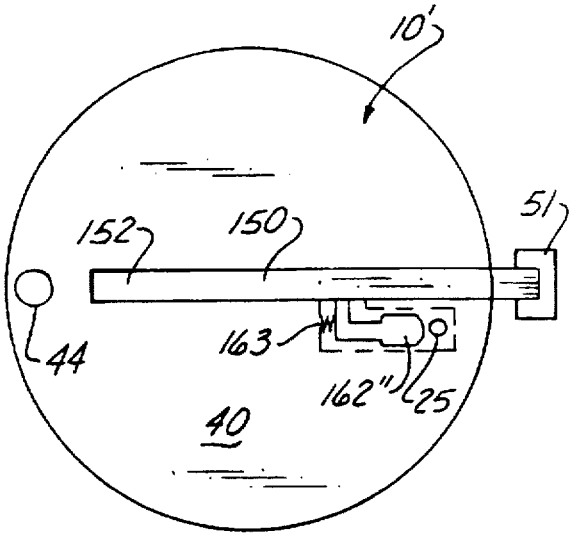
FIG. 9 is a partial cut away view of an alternate version of the preferred embodiment.
Figure 11:
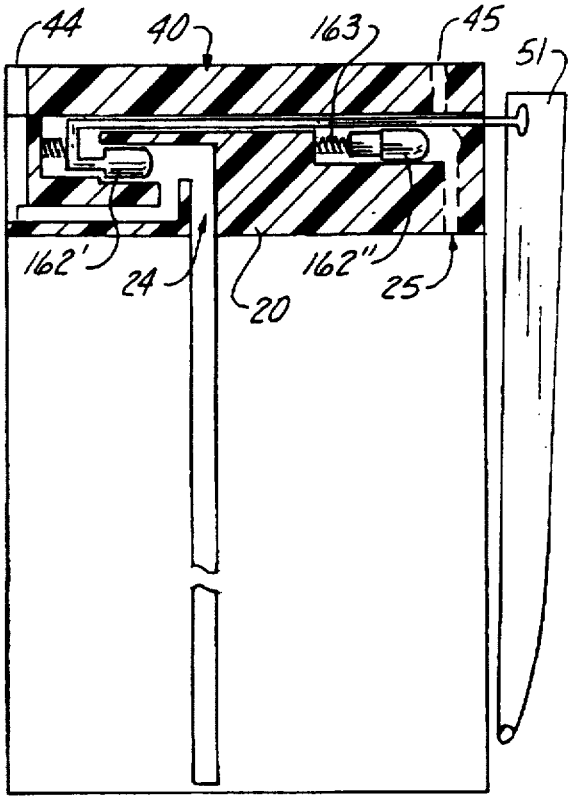
FIG. 11 is a cross-sectional view of the alternate version of the receptacle cover; and, FIG. 12 is a partial cut away view of yet another version of the preferred embodiment.

As shown in FIGS. 9 thru 11, the fluid supply valve head 162' is disposed beneath the inboard end of the actuator rod 152; whereas, the vent valve head 162" disposed generally perpendicular to the flow of air through the vent passageway. Furthermore, the fluid supply inlet port 24 and outlet port 44 are disposed parallel yet offset from one another with the fluid supply valve head 162' likewise disposed generally perpendicular to the fluid supply passageways 24 44.

Figure 12:
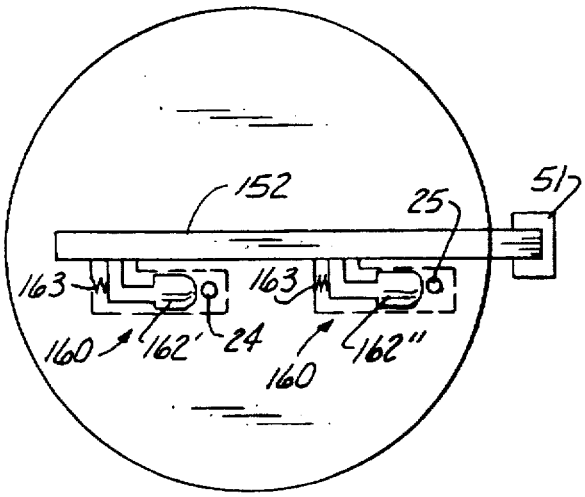

In yet another version of the preferred embodiment illustrated in FIG. 12, both of the valve members 160 are offset from the actuator rod 152 and both the vent passageways 25 45 and the supply passageways 24 44 are axially aligned; wherein, the valve heads 162' and 162" are disposed perpendicular to the respective passageways 25 45 and 24 44 in a well recognized fashion.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A cover for a drink receptacle wherein the cover comprises:

a base unit provided with an inlet supply aperture in open fluid communication with a fluid supply chamber and a base vent aperture in open fluid communication with a vent chamber;

a lid unit operatively associated with the base unit and comprising a lid member provided with a raised mouthpiece and a lid vent aperture; wherein the raised mouthpiece is operatively connected to the fluid supply chamber, and the lid vent aperture is operatively connected to the vent chamber;

an actuator unit including a generally T-shaped actuator element slideably disposed within the base unit, wherein the cross of the T-shaped actuator element forms arms, wherein the arms of the actuator unit are provided with valve means for controlling the flow of fluid through the fluid supply chamber and the vent chamber; and means for reciprocating the actuator element relative to the base unit for controlling the position of the valve means relative to the fluid supply chamber and the vent chamber.

2. The cover as in claim 1 wherein said valve means comprises a pair of valve members, wherein each valve member includes a valve stem connected on one end to one of the arms of the actuator member and connected on the other end to a valve head; wherein, each of the valve heads is dimensioned to be received within one of said chambers.

3. The cover as in claim 2 wherein the mouthpiece is further provided with a snap-in extension element.

4. The cover as in claim 2 wherein each of said chambers is provided with a pair of valve seats, and each of said valve ends is dimensioned to sealingly engage said pair of valve seats in a given chamber.

5. The cover as in claim 4 wherein said pair of valve seats in each chamber are disposed generally perpendicular to one another.

6. The cover as in claim 1 wherein said means for reciprocating the actuator element relative to the base unit includes a helical spring operatively associated with each of said valve stems.

7. The cover as in claim 6 wherein said means for reciprocating the actuator element relative to the base unit further includes a handle element operatively associated with the stem portion of said T-shaped actuator element.

8. The cover as in claim 7 wherein the handle element depends downwardly from the stem portion of the actuator element.

9. The cover as in claim 1 wherein the lid unit is further provided with a raised peripheral lip.

10. A cover for a drink receptacle wherein the cover comprises:

a base unit provided with an inlet supply aperture in open fluid communication with a fluid supply chamber and a base vent aperture in open fluid communication with a vent chamber;

a lid unit operatively associated with the base unit and comprising a lid member provided with a raised mouthpiece and a lid vent aperture; wherein the raised mouthpiece is operatively connected to the fluid supply chamber, and the lid vent aperture is operatively connected to the vent chamber;

an actuator unit including a generally elongated actuator element provided with a pair of generally L-shaped valve arms and slideably disposed within the base unit, wherein the arms of the actuator unit are provided with valve means for controlling the flow of fluid through the fluid supply chamber and the vent chamber; and means for reciprocating the actuator element relative to the base unit for controlling the position of the valve means relative to the fluid supply chamber and the vent chamber.

11. The cover as in claim 10; wherein, at least one of the generally L-shaped valve arms are offset from the longitudinal axis of said actuator element.

12. The cover as in claim 10; wherein, both of the valve arms are offset from the longitudinal axis of said actuator element.

* * * * *